US010355363B2

(12) United States Patent
Pajona et al.

(10) Patent No.: US 10,355,363 B2
(45) Date of Patent: Jul. 16, 2019

(54) ANTENNA-LIKE MATCHING COMPONENT

(71) Applicant: ETHERTRONICS, INC., San Diego, CA (US)

(72) Inventors: Olivier Pajona, Nice (FR); Sebastian Rowson, San Diego, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 15/862,553

(22) Filed: Jan. 4, 2018

(65) Prior Publication Data

US 2018/0131097 A1 May 10, 2018

Related U.S. Application Data

(63) Continuation of application No. 14/213,959, filed on Mar. 14, 2014, now Pat. No. 9,893,427.

(60) Provisional application No. 61/838,555, filed on Jun. 24, 2013, provisional application No. 61/785,405, filed on Mar. 14, 2013.

(51) Int. Cl.
*H01Q 9/36* (2006.01)
*H01Q 5/50* (2015.01)

(52) U.S. Cl.
CPC ..... *H01Q 9/36* (2013.01); *H01Q 5/50* (2015.01)

(58) Field of Classification Search
CPC .. H01Q 1/38; H01Q 9/36; H01Q 5/50; H01Q 9/0407
USPC ..... 343/702, 745, 749–752, 850–853, 343/860–862
See application file for complete search history.

(56) References Cited

U.S. PATENT DOCUMENTS

| | | | | |
|---|---|---|---|---|
| 5,008,681 | A * | 4/1991 | Cavallaro | H01Q 19/005 343/700 MS |
| 6,765,536 | B2 | 7/2004 | Phillips et al. | |
| 6,987,493 | B2 | 1/2006 | Chen | |
| 7,068,234 | B2 | 6/2006 | Sievenpiper | |
| 7,079,079 | B2 * | 7/2006 | Jo | H01Q 1/243 343/700 MS |
| 7,084,831 | B2 * | 8/2006 | Takagi | H01Q 1/243 343/702 |
| 7,215,289 | B2 | 5/2007 | Harano | |
| 7,830,320 | B2 | 11/2010 | Shamblin | |
| 7,911,402 | B2 | 3/2011 | Rowson et al. | |
| 8,362,962 | B2 | 1/2013 | Rowson et al. | |
| 8,446,318 | B2 | 5/2013 | Ali et al. | |
| 8,648,755 | B2 | 2/2014 | Rowson et al. | |
| 8,717,241 | B2 | 5/2014 | Shamblin et al. | |
| 8,976,068 | B2 | 3/2015 | Hamabe | |
| 9,001,000 | B2 * | 4/2015 | Satou | H01Q 5/22 343/702 |
| 9,240,634 | B2 | 1/2016 | Rowson et al. | |
| 2002/0067312 | A1 | 6/2002 | Hilgers | |
| 2004/0075614 | A1 | 4/2004 | Dakeya | |
| 2006/0044187 | A1 | 3/2006 | Sager | |
| 2008/0001823 | A1 * | 1/2008 | Jung | H01Q 1/243 343/700 MS |

(Continued)

*Primary Examiner* — Dameon E Levi
*Assistant Examiner* — Hasan Z Islam
(74) *Attorney, Agent, or Firm* — Dority & Manning, P.A.

(57) ABSTRACT

An antenna-like matching component is provided, comprising one or more conductive portions formed on a substrate. Shapes and dimensions of the one or more conductive portions are determined to provide impedance matching for one or more antennas coupled to the matching component.

11 Claims, 14 Drawing Sheets

(56) References Cited

U.S. PATENT DOCUMENTS

| | | | | |
|---|---|---|---|---|
| 2011/0133993 | A1 | 6/2011 | Utagawa | |
| 2012/0013519 | A1 | 1/2012 | Hakansson | |
| 2012/0184228 | A1* | 7/2012 | Mujtaba | H04B 1/04 455/103 |
| 2012/0242547 | A1* | 9/2012 | Fujii | H01Q 1/38 343/700 MS |
| 2013/0064149 | A1 | 3/2013 | Huang | |
| 2013/0162496 | A1* | 6/2013 | Wakabayashi | H01Q 21/00 343/853 |
| 2014/0266917 | A1* | 9/2014 | De Luis | H01Q 19/005 343/700 MS |

* cited by examiner

ANTENNA-LIKE MATCHING COMPONENT

CROSS-REFERENCE TO RELATED APPLICATIONS

This application is a continuation of U.S. Ser. No. 14/213,959, filed Mar. 14, 2014; which claims benefit of priority with U.S. Ser. No. 61/838,555, filed Jun. 24, 2013; and further claims benefit of priority with U.S. Ser. No. 61/785,405, filed Mar. 14, 2013;

the contents of each of which are hereby incorporated by reference.

BACKGROUND

Frequency bands associated with various protocols are specified per industry standards for cell phone and mobile device applications, WiFi applications, WiMax applications and other wireless communication applications. As new generations of wireless communication systems become smaller and packed with more multi-band functions, design of new types of antennas and associated air interface circuits is becoming increasingly important. As the antenna's radiator becomes smaller and more integrated within the system, the impact on the antenna's impedance becomes significant, leading to a narrower bandwidth for a constant return loss. The narrow bandwidth in term of the return loss limits the power transfer to the antenna and the number of frequency bands that the antenna can support. It also reduces the robustness of the system since a communication system with an air interface tends to be affected by use conditions such as the presence of a human hand, a head, a metal object or other interference-causing objects placed in the vicinity of an antenna, resulting in impedance mismatch and frequency shift at the antenna terminal. A narrow frequency bandwidth makes the system sensitive to such phenomena. Accordingly, increasing the bandwidth has been one of the goals in many antenna designs. Conventional ways to achieve the goal includes the use of either a passive matching circuit made of distributed or discrete lumped components, or an active matching solution. A passive matching circuit tends to become inefficient and/or too complex when many components are used, while more and more components are needed in the matching circuit to match multiple frequency bands. An active solution provides more flexibility than the passive counterpart, but raises cost and complexity challenges as well as non-linearity and power consumption.

DETAILED DESCRIPTION

Figure 1:
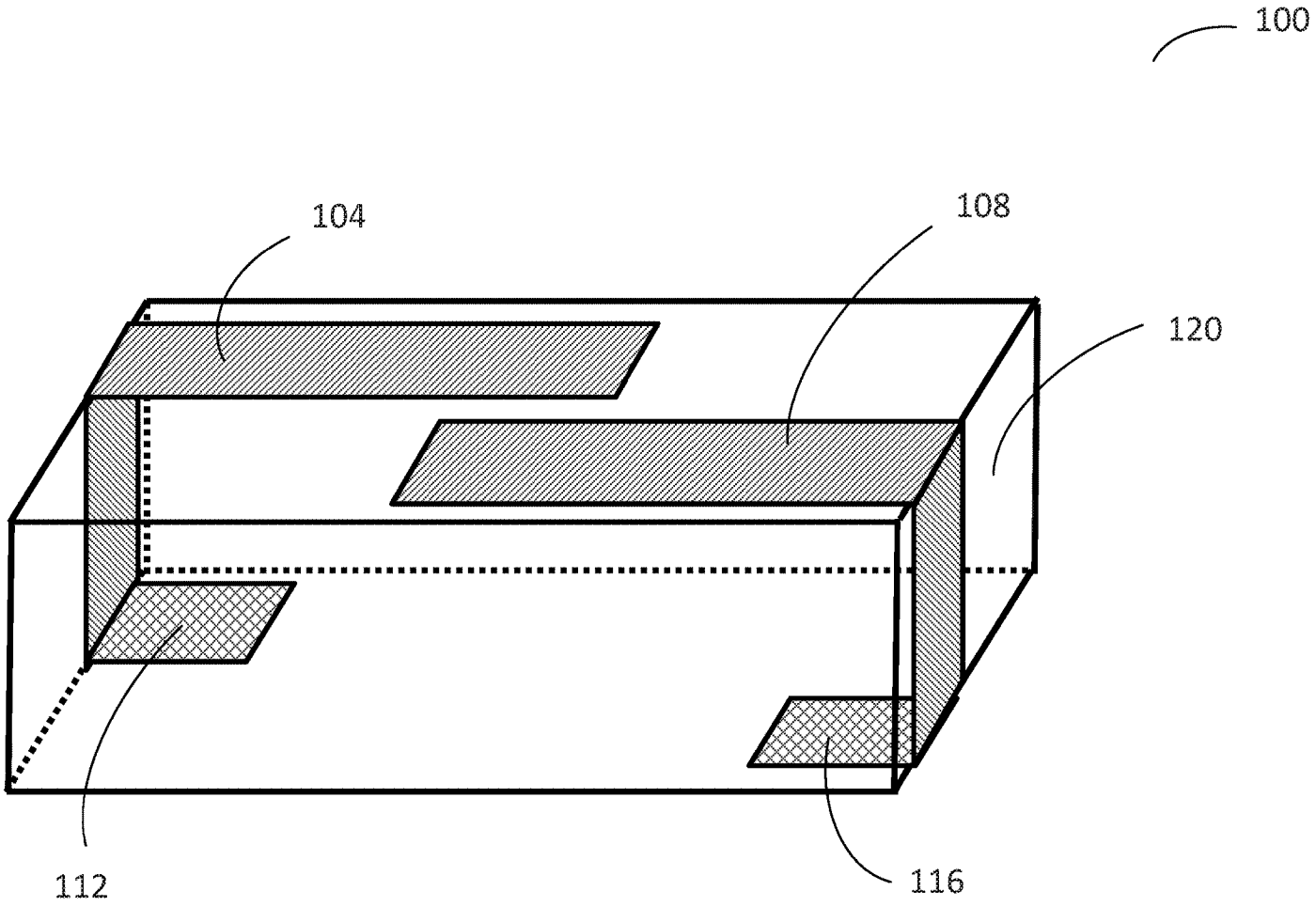
FIG. 1 illustrates an example of a matching component.

A communication system with a passive antenna is generally not capable of readjusting its functionality to recover optimum performances when a change in impedance detunes the antenna, causing a change in system load and a shift in frequency. Impedance matching is therefore an important design consideration for maximizing power transfer in the system. A matching circuit is generally implemented in such a system to achieve the typical 50Ω matching. This document describes a new type of matching scheme utilizing antenna-like properties of a matching component. Details are described below with reference to the corresponding figures.

Impedance matching for a system with a multi-band or wideband antenna has been difficult, since the matching circuit needs to be designed to provide proper impedance over a wide range of frequencies and conditions. Conventional matching theories are related to filtering theories, based on, for example, complex loads, polynomial series, serial and parallel equalizers, etc. A matching circuit typically includes lumped components such as capacitors and/or inductors configured based on RLC analytical studies. For certain types of antennas, matching circuit loss is critical and is required to be less than ~0.5 dB for many applications. This requirement severely limits the number of components used in the matching circuit, for example, to less than four, for a small-antenna system. Instead of the above passive schemes, active matching schemes can be implemented for wideband matching; however, the matching circuit loss in this case could reach as high as ~1 dB.

Alternatively, a tunable matching network can be implemented in the system to provide proper impedance based on information on the mismatch. For example, the U.S. patent application Ser. No. 13/675,981, entitled "TUNABLE MATCHING NETWORK FOR ANTENNA SYSTEMS," filed on Nov. 13, 2012, describes a flexible and tailored matching scheme capable of maintaining the optimum system performances for various frequency bands, conditions, environments and surroundings. In particular, this tailored matching scheme provides matching network configurations having impedance values tailored for individual scenarios. This scheme is fundamentally different from a conventional scheme of providing beforehand impedance values corresponding to discrete points in the Smith chart based on combinations of fixed impedance values, which may be unnecessarily excessive, wasting real estate, and/or missing optimum impedance values. Specifically, in the conventional fixed-impedance scheme, termed a binary scheme herein, the capacitors and switches are binary-weighted from a least significant bit (LSB) to a most significant bit (MSB). On the other hand, in the tailored scheme, impedance values are optimized in advance according to frequency bands and detectable conditions including use conditions and environments. The selection of impedance states optimal for individual scenarios can be controlled by switches in the tunable matching network.

Most impedance matching methods involve designing of RLC circuits and combinations thereof to complement the antenna impedance for achieving the 50Ω matching. Switches can also be included for active matching. It should be noted that antenna impedance as a function of frequency can have a wide variety of forms depending on the type of antenna. For example, the antenna can be monopole, dipole, inverted F antenna (IFA), planar inverted F antenna (PIFA), patch antenna, slot antenna, and so on. Furthermore, many antenna variations can be provided by adding conductive elements such as meander lines, straight or bent arms, parasitic elements, and so on. These antennas have respective impedance forms as a function of frequency. Based on this observation, this document presents a new concept of using an antenna-like matching component in order to complement the antenna impedance to achieve proper impedance matching over a wide frequency range.

FIG. 1 illustrates an example of a matching component 100. This component includes conductive patches 104, 108, 112 and 116 printed on a substrate 120. The conductive patch 104 may be a driving element 104 coupled to a solder pad 112, which may be electrically coupled to a transmission line coupled an RF path. The conductive patch 108 may be a parasitic element 108 coupled to a solder pad 116, which may be electrically coupled to ground, kept open, or coupled to another circuit. The substrate 120 may be made of a dielectric material such as ceramic, alumina, FR4-PCB, etc. This particular example resembles a monopole antenna with a parasitic element, giving rise to corresponding impedance form as a function of frequency. Shapes and dimensions of the driving element 104 and the parasitic element 108 can be varied according to the impedance to be matched. The parasitic element 108 and the associated solder pad 116 may be omitted. Furthermore, meander lines, extended arms and/or other conductive elements can be added to the driving element 104 and/or the parasitic element 108 to have a wide variety of impedance forms over a wide frequency range. These added conductive elements as well as the conductive patches, i.e., the driving element, the parasitic element and the solder pads, which are formed on the substrate, are collectively called conductive portions in this document. Having an antenna-like conductive pattern on the substrate 120, the matching component 100 provides a pick-and-place solution especially suited for multi-band or wideband impedance matching.

Figure 2:
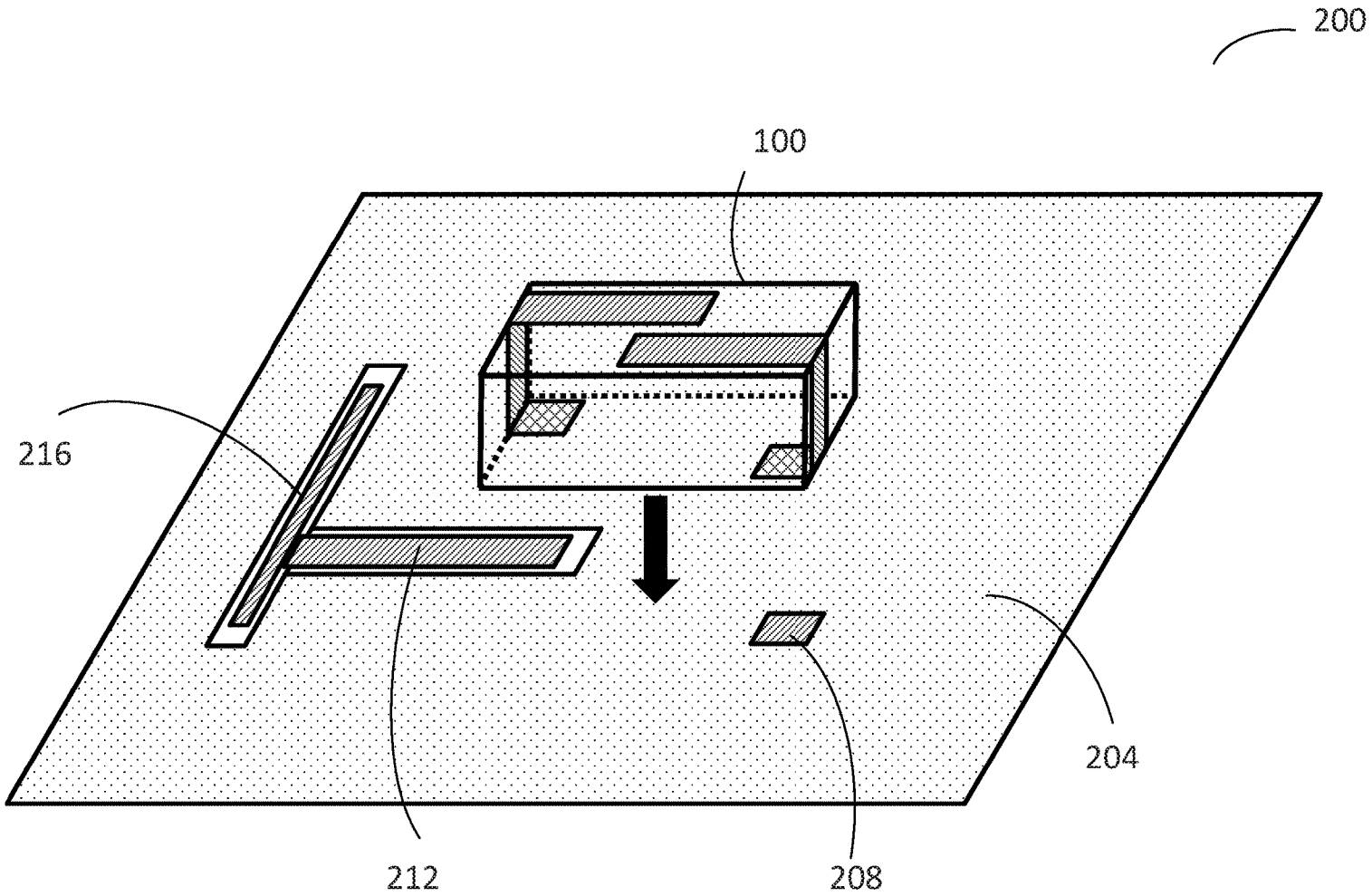
FIG. 2 illustrates an example of assembly of the matching component onto a PCB.

FIG. 2 illustrates an example of assembly 200 of the matching component 100 illustrated in FIG. 1 onto a PCB 204. In this assembly example, the parasitic element 108 coupled to ground 204 through the solder pad 116, and the driving element 104 is coupled to a transmission line 212 through the solder pad 112. The transmission line 212 is coupled in shunt to an RF path 216, where one end of the RF path 216 may be coupled to an antenna and the other end of the RF path 216 may be coupled to an RF front-end module.

Figure 3:
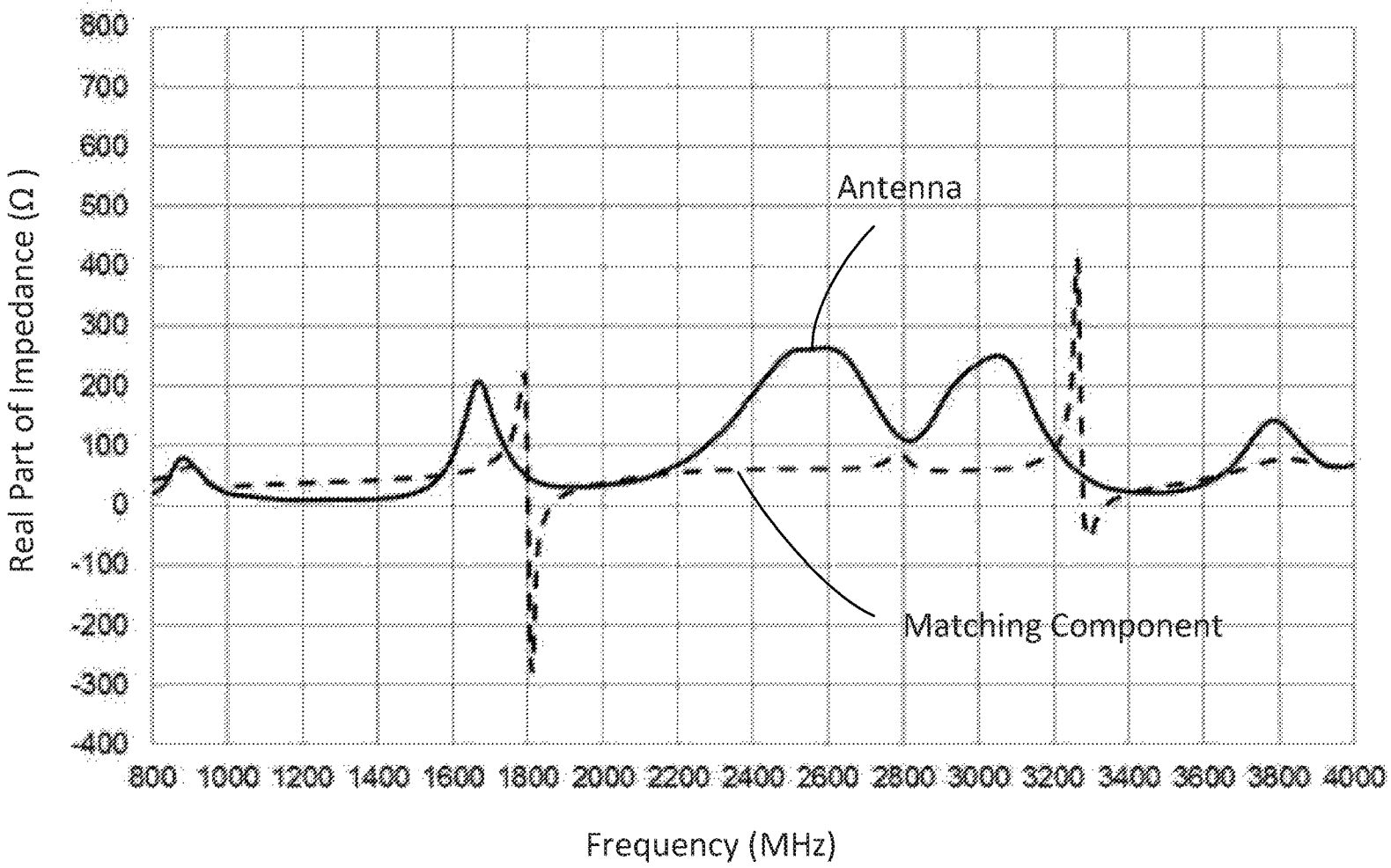
FIGS. 3, 4 and 5 show simulation results illustrating the comparison between the penta-band antenna and the matching component in terms of the real part of impedance, the imaginary part of impedance and the return loss, respectively.
Figure 4:
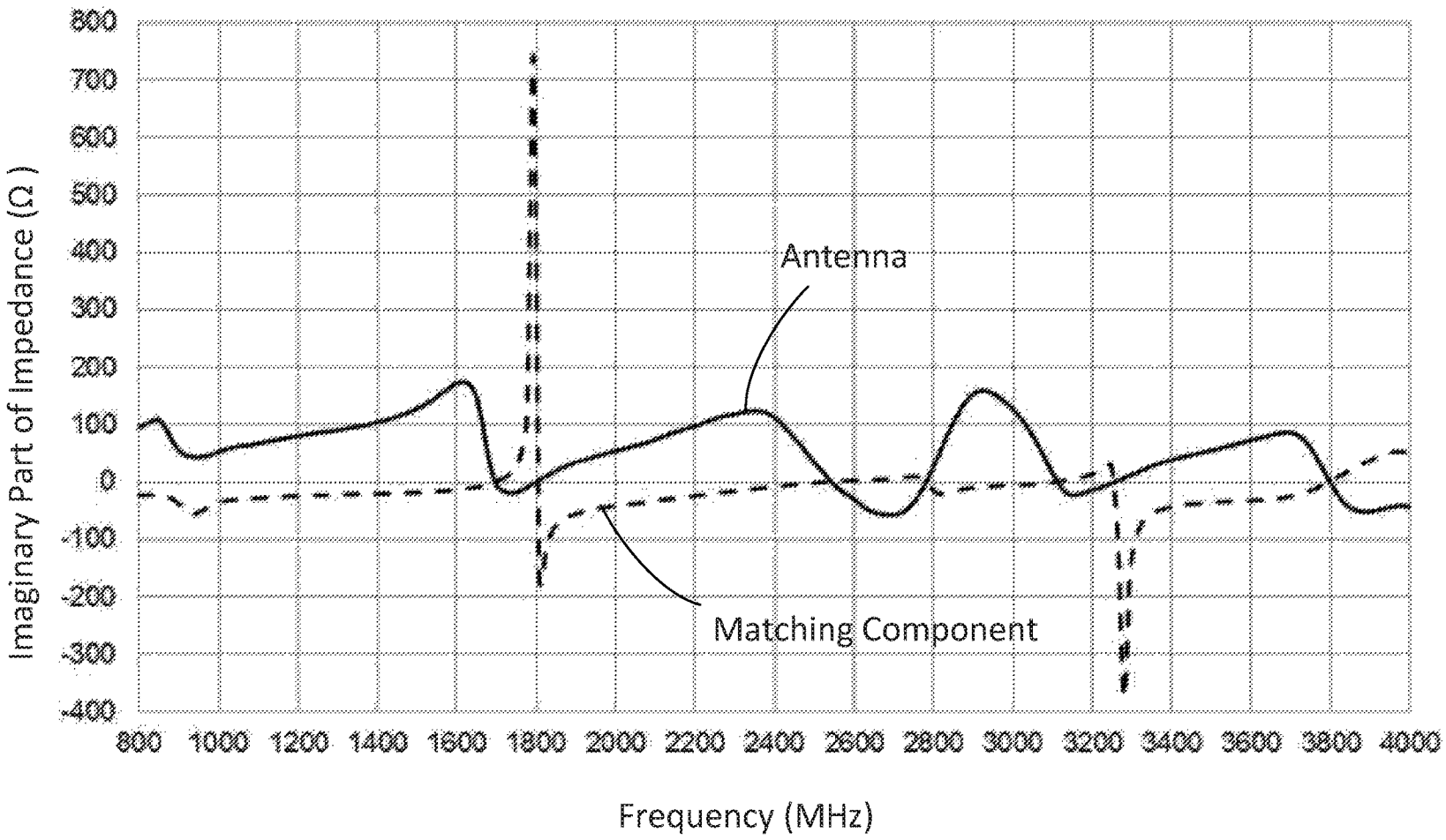
Figure 5:
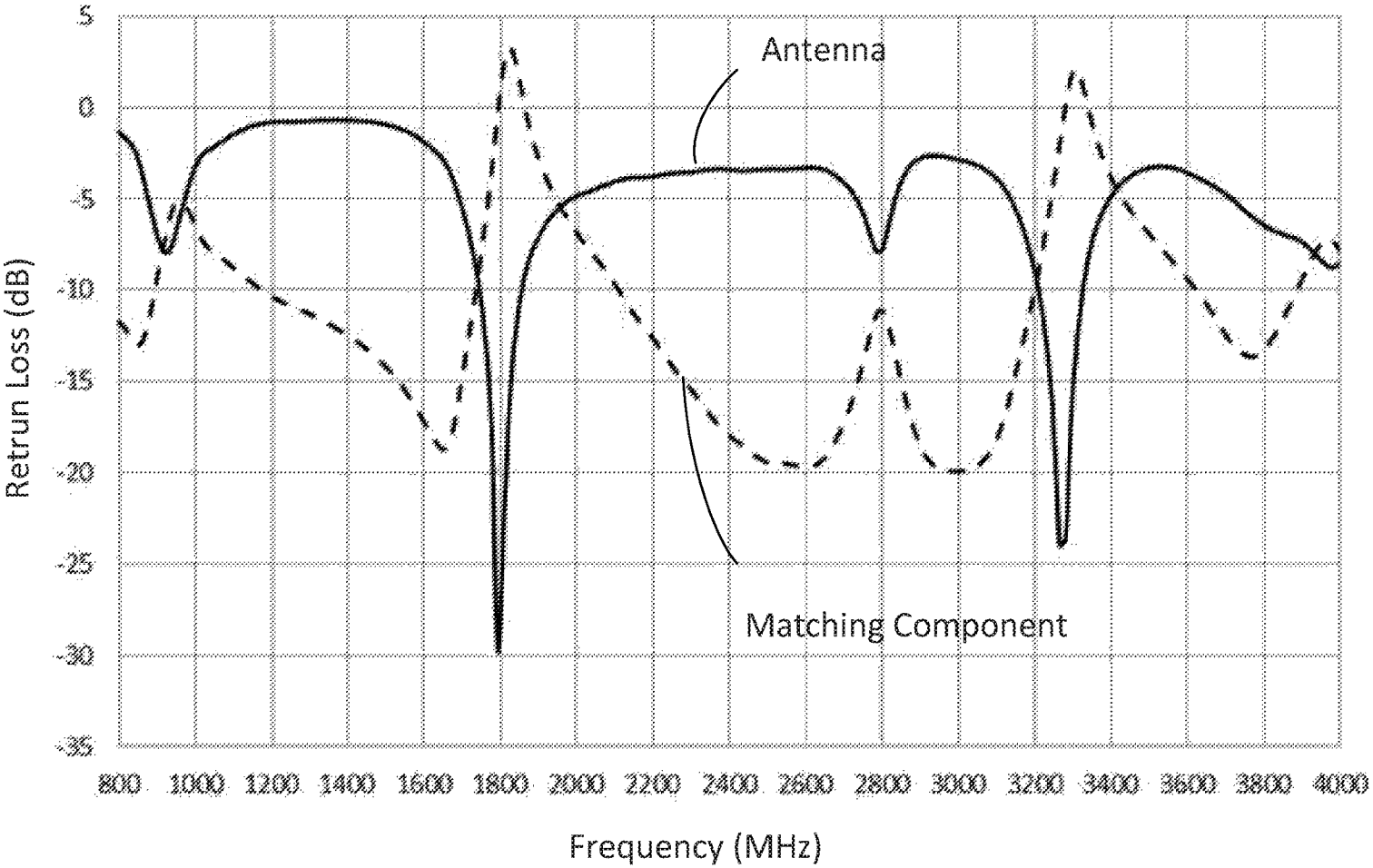

Simulations were carried out to obtain impedance to match a multi-band or wideband antenna to 50Ω over a bandwidth of 800 MHz to 4 GHz as an example. By varying the shapes and dimensions of the driving element 104 and the parasitic element 108 of the matching component 100, it is possible to obtain a configuration that can provide the impedance as a function of frequency close to the one targeted and therefore to achieve a very good matching for the penta-band antenna, i.e., 850, 900, 1900, 2100 and 1700/2100 MHz bands, in this example. FIGS. 3, 4 and 5 show simulation results illustrating the comparison between the penta-band antenna and the matching component 100 in terms of the real part of impedance, the imaginary part of impedance and the return loss, respectively.

Figure 6:
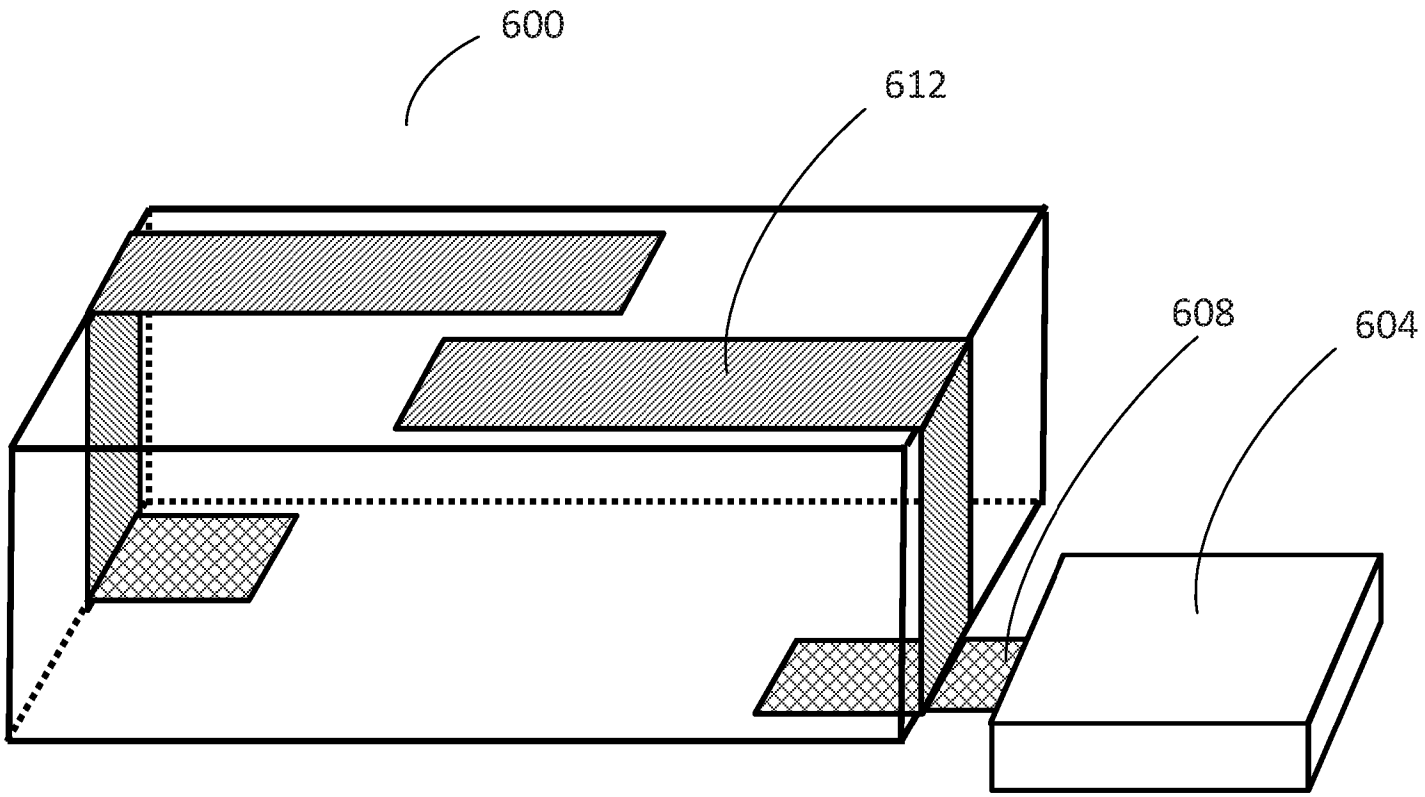
FIG. 6 illustrates an example of a configuration including a matching component and a circuit block.

FIG. 6 illustrates an example of a configuration including a matching component and a circuit block. Here the matching component 600 may be same as the one illustrated in FIG. 1, or may be configured to have different shapes and dimensions of the conductive patches and/or a different substrate material. The circuit block 604 may include one or more electronic components, i.e., capacitors, inductors, switches, varactors, transmission lines, etc., and the impedance with respect to its output port is different from the impedance with respect to its input port. In other words, this is an impedance-varying circuit block. In this example, the circuit block 604 is coupled a solder pad 608, which is coupled to a parasitic element 612 of the matching component 600. The configuration having both a matching component and an impedance-varying circuit block, such as the one illustrated in FIG. 6, can be used to fine-tune the impedance matching by adjusting the designs of the matching component, the circuit block, or a combination of both.

Figure 7:
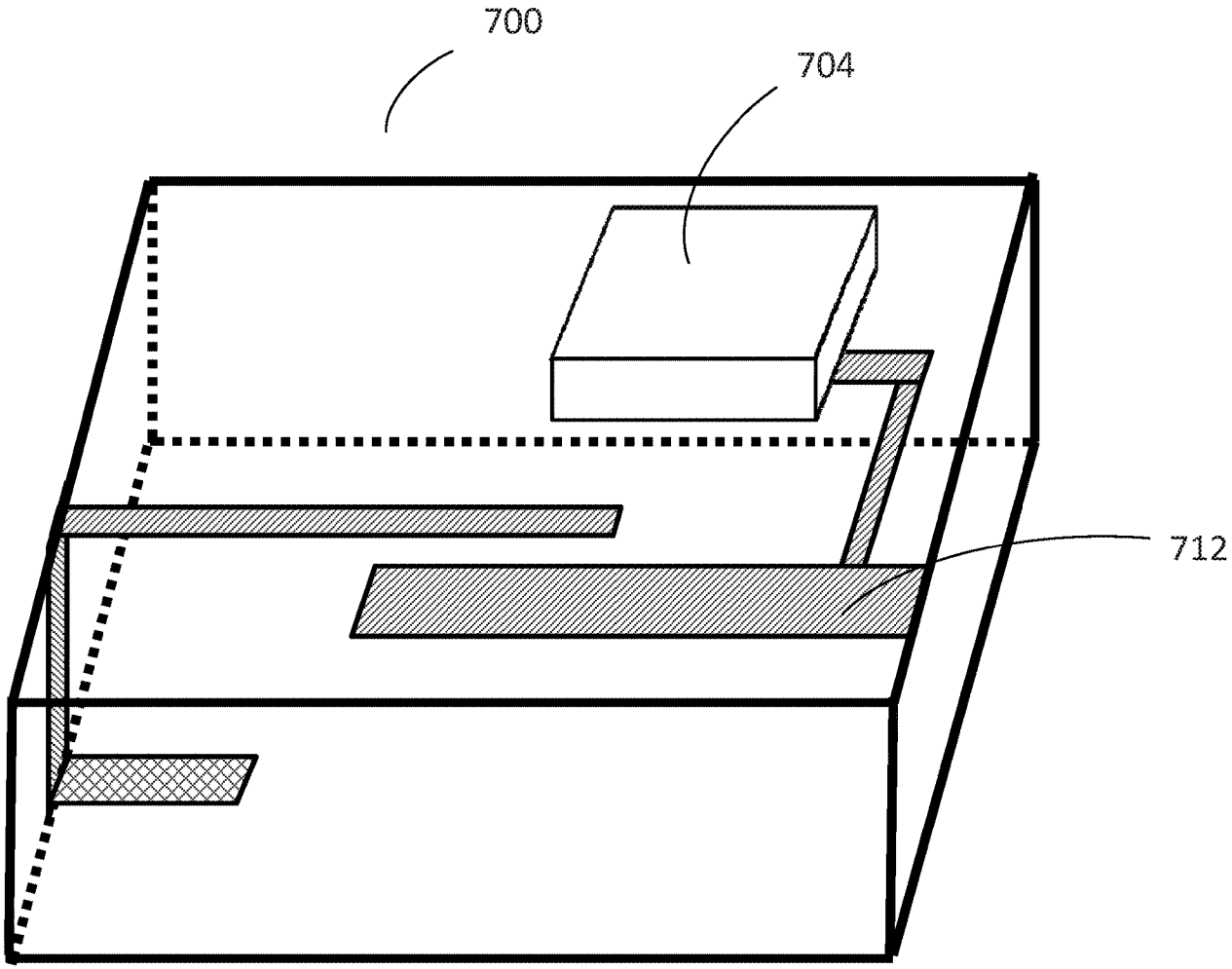
FIG. 7 illustrates another example of a configuration including a matching component and a circuit block.

FIG. 7 illustrates another example of a configuration including a matching component and a circuit block. In this example, the circuit block 704 is placed on the top surface of the matching component 700, giving rise to an integrated configuration. In this example, the parasitic element 712 has an extended L-shaped arm attached to the rectangle patch, and is coupled directly to the circuit block 704. The configuration having both a matching component and an impedance-varying circuit block, such as the one illustrated in FIG. 7, can be used to fine-tune the impedance matching by adjusting the designs of the matching component, the circuit block, or a combination of both.

A communication system can generally be designed to support one or more frequency bands. A single antenna may be used to cover both transmit (Tx) and receive (Rx) bands, or separate Tx antenna and Rx antenna may be used. A single-pole-multiple-throw switch, for example, may be employed to engage one of the multiple RF paths according to the band of the signal from or to the antenna. Such a switch can provide a certain level of isolation among the multiple RF paths. However, the use of semiconductor switches for the signal routing may pose cost disadvantages, for example, in some applications that require expensive GaAs FETs. Furthermore, in some systems, power leak from one path to another may still occur even when such a switch is used. With the advent of advanced filter technologies such as Bulk Acoustic Wave (BAW), Surface Acoustic Wave (SAW) or Film Bulk Acoustic Resonator (FBAR) filter technology, the band path filter technology tends to increase the maximum ratings for input power. Thus, these filters can provide resilience to the power leak as well as steep and high rejection characteristics. However, these filters are often fabricated based on a costly platform, for example, Low Temperature Co-fired Ceramic (LTCC) technology. Furthermore, the steep and high rejection characteristics of these filters often leads to high insertion loss, giving rise to degraded power transmission in the pass band.

In addition to isolation considerations as above, the practical implementation of RF communication systems involves matching of different impedances of coupled blocks to achieve a proper transfer of signal and power. The 50Ω matching is employed for a typical communication system, as mentioned earlier. The isolation may be improved by the impedance matching individually configured for the RF paths, in addition to isolation provided by switches or physical separation of the RF paths. Physically separated RF paths can be realized by using multiple antennas having respective feeds, hereinafter referred to single-feed antennas, wherein each feed can be coupled to one of the RF paths.

In addition or alternatively to using multiple single-feed antennas, a multi-feed antenna, which can be coupled to two or more RF paths, may be used to provide isolation among the RF paths by providing the physical separation of the RF paths as well as configuring impedance matching for individual paths. Examples and implementations of multi-feed antennas are described in U.S. application Ser. No. 13/548,211, entitled "MULTI-FEED ANTENNA FOR PATH OPTIMIZATION," filed on Jul. 13, 2012. Note, however, that antennas with any type of multi-feed techniques and configurations can be used for the system.

Figure 8:
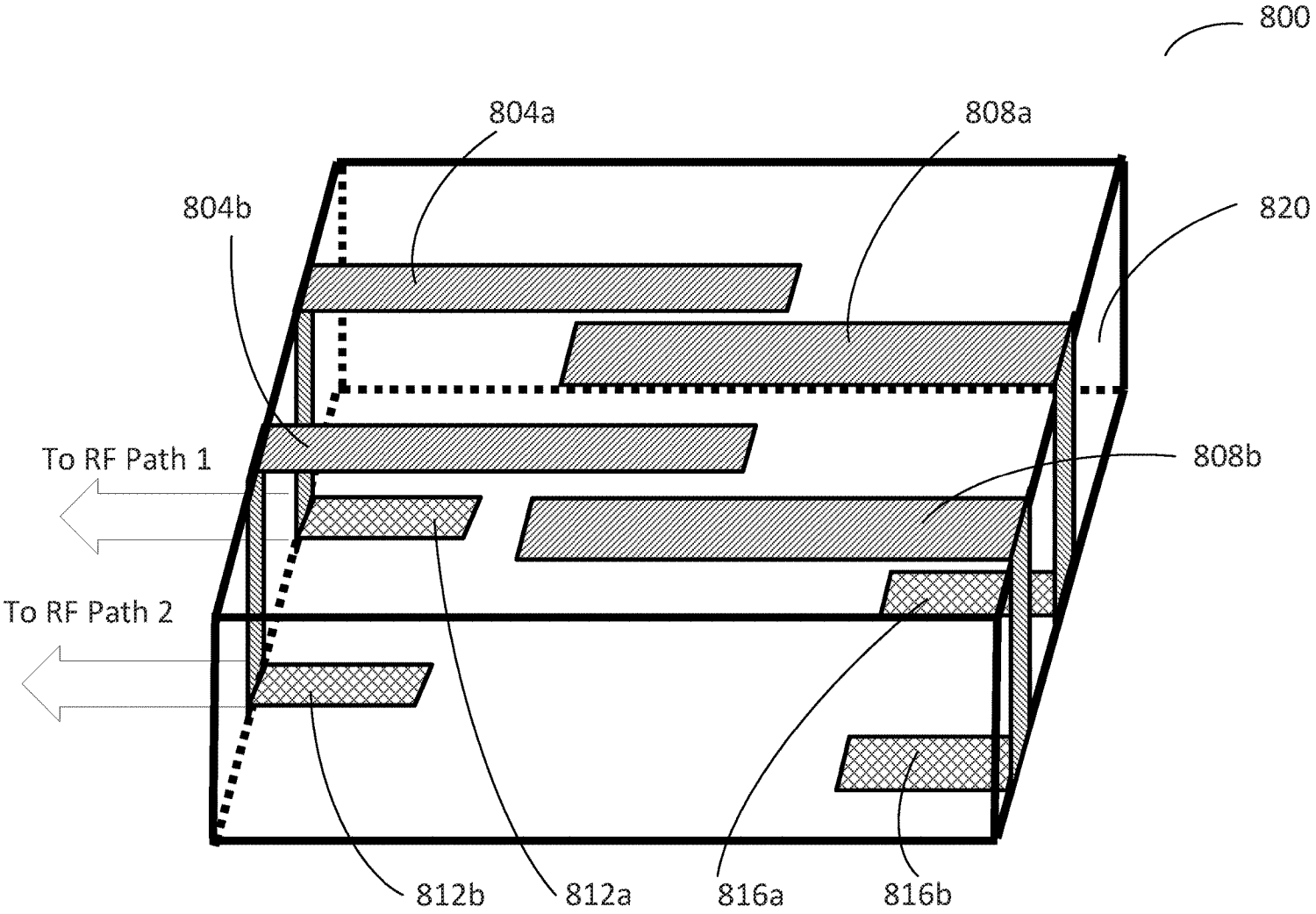
FIG. 8 illustrates an example of a matching component for a dual-band system.

Designs and implementations of the matching component described earlier with reference to FIGS. 1-7 can be extended for a multi-band system, such as a MIMO system, in which multiple RF paths are subject to isolation and impedance matching considerations. FIG. 8 illustrates an example of a matching component 800 for a dual-band system. This component includes conductive patches 804*a*, 804*b*, 808*a*, 808*b*, 812*a*, 812*b*, 816*a* and 816*b* printed on a substrate 820. This example is for a dual-band system having two RF paths, RF path 1 and RF path 2, supporting two different bands. These RF paths couple an RF front end module with one dual-feed antenna or two antennas having respective two feeds. The conductive patch 804*a* may be a first driving element 804*a* coupled to a first solder pad 812*a*, which may be electrically coupled to a transmission line coupled in shunt to the RF path 1, as in the example illustrated in FIG. 2. The conductive patch 808*a* may be a first parasitic element 808*a* coupled to a second solder pad 816*a*, which may be electrically coupled to ground, kept open, or coupled to another circuit. The conductive patch 804*b* may be a second driving element 804*b* coupled to a third solder pad 812*b*, which may be electrically coupled to a transmission line coupled in shunt to the RF path 2, as in the example illustrated in FIG. 2. The conductive patch 808*b* may be a second parasitic element 808*b* coupled to a fourth solder pad 816*b*, which may be electrically coupled to ground, kept open, or coupled to another circuit. The substrate 820 may be made of a dielectric material such as ceramic, alumina, FR4-PCB, etc. This particular example resembles two monopole antennas with parasitic elements, giving rise to corresponding impedance form as a function of frequency. Shapes and dimensions of the first and second driving elements 804*a* and 804*b* as well as the first and second parasitic elements 808*a* and 808*b* can be varied according to the impedance to be matched. Designs and implementations of the matching component 800 for a dual-band system can be extended for a system with triple or more bands by increasing the number of and varying the dimensions and shapes of individual conductive patches. The number of driving elements and the number of parasitic elements may be the same or different. Furthermore, meander lines, extended or bent arms and/or other conductive elements can be added to have a wide variety of impedance forms over a wide frequency range. These added conductive elements as well as the conductive patches, i.e., the driving elements, the parasitic elements and the solder pads, which are formed on the substrate, are collectively called conductive portions in this document. Having an antenna-like conductive pattern on the substrate 820, the matching component 800 provides a pick-and-place solution especially suited for multi-band or wideband impedance matching.

Figure 8A:
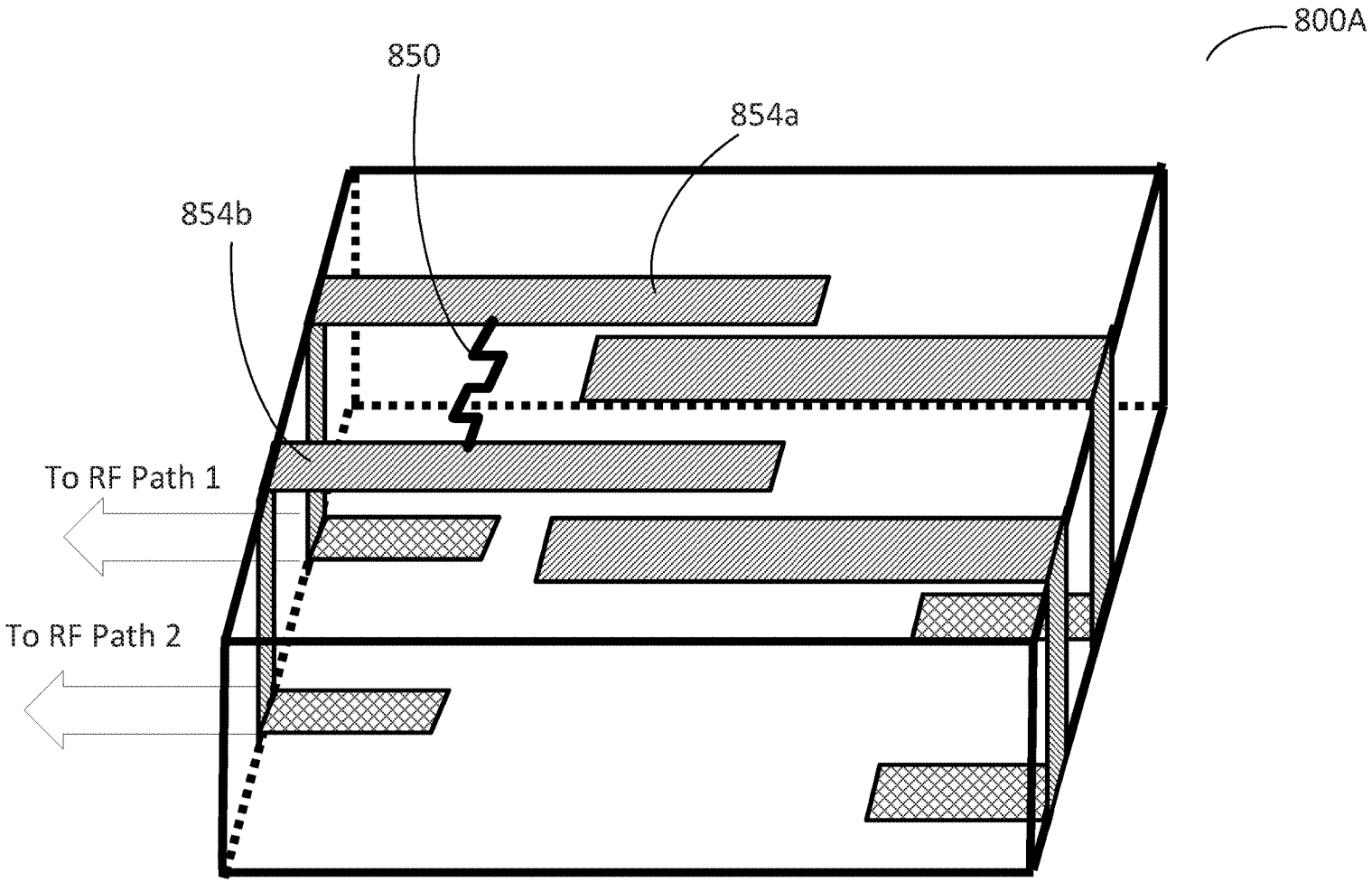
FIG. 8A illustrates another example of a matching component for a dual-band system.

FIG. 8A illustrates another example of a matching component 800A for a dual-band system. As in the previous example illustrated in FIG. 8, this matching component includes conductive portions printed on a substrate, such as the driving elements, parasitic elements and solder pads; and the dual-band system includes two RF paths, RF path 1 and RF path 2, supporting two different bands. The present example is for a specific case in which the RF paths couple an RF front end module with two antennas having respective two feeds. As known to those skilled in the art, multiple antennas in a system tend to interact with each other due to the electromagnetic proximity effects, e.g., capacitive coupling effects. In order to reduce such effects and increase isolation between the antennas, an inductive element 850 is included to connect two driving elements 854*a* and 854*b*, which are separately coupled to the two different antennas through RF path 1 and RF path 2, respectively. In the example of FIG. 8A, a meander line is used for the inductive element 850. However, the shape and dimension of the inductive element 850 can be varied depending on the level of isolation sought in the design. Examples may include a rectangular or polygonal shape, a zig-zag pattern, a meander with one or more bends, and so on. In general, the narrower the width of the inductive element 850 is, the more inductive it is. Designs and implementations of the matching component 800A for a dual-band system can be extended for a system with triple or more bands by increasing the number of and varying the dimensions and shapes of individual conductive portions including the inductive element. In a multi-band system supporting multiple bands, one or more inductive elements can be included, each connecting a pair of driving elements coupled to two different antennas, respectively, in order to increase isolation between the antennas.

Based on the configuration including a matching component and a circuit block for a single-band system such as illustrated in FIG. 6 or 7, one or more parasitic elements of a matching component for a multi-band system may be coupled to one or more circuit blocks, respectively. With reference to a specific example for the dual-band system illustrated in FIG. 8, one of the parasitic elements 808*a* and 808*b* may be coupled to one circuit block, or both the parasitic elements 808*a* and 808*b* may be coupled to respective circuit blocks. The configuration having both a matching component for a multi-band system and one or more impedance-varying circuit blocks can be used to fine-tune the impedance matching by adjusting the designs of the matching component, the one or more circuit blocks, or a combination of both.

Figure 9:
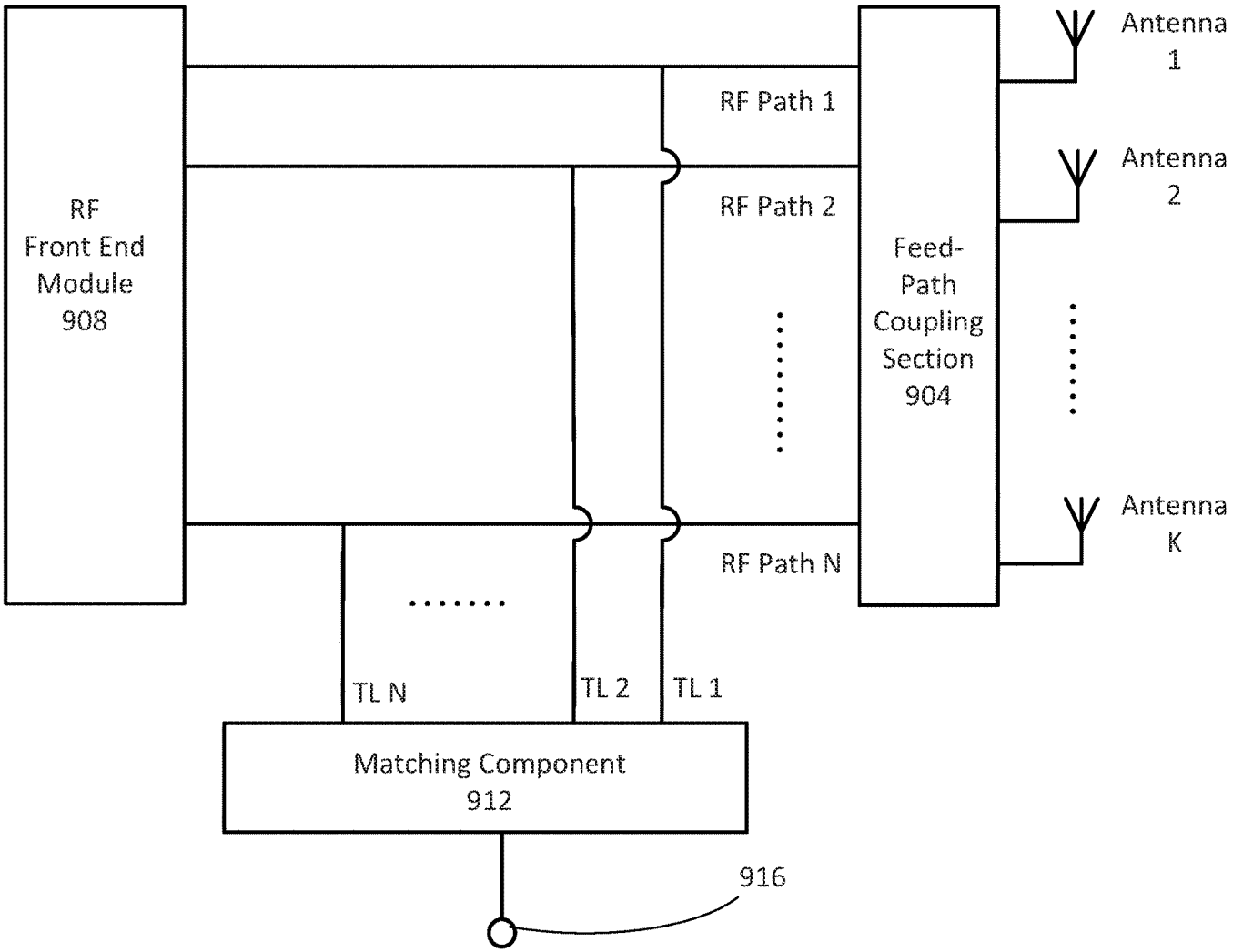
FIG. 9 illustrates an example of a communication system including one or more antennas and a matching component.

FIG. 9 illustrates an example of a communication system including one or more antennas and a matching component. In this example, K antennas, labeled Antenna 1, Antenna 2 . . . and Antenna K, are included, where K≥1. At least one antenna may be a multi-feed antenna and the others may be single-feed antennas; all antennas may be single-feed antennas; or only one multi-feed or single-feed antenna may be used (i.e., K=1). In each of the antenna configurations, the present system is configured to provide N feeds, where N≥1. Thus, the system in this example is configured to support N different bands with N RF paths, labeled RF Path 1, RF Path 2 . . . and RF Path N, respectively. Here, the N RF paths are coupled to the N-number of feeds, respectively, via a feed-path coupling section 904, in a capacitive way, an inductive way, a combination of both or other suitable methods. The other ends of the RF paths are coupled to an RF front end module 908. A matching component 912 is configured for an N-band system in this example, and coupled in shunt to each of the RF paths through transmission lines TL1, TL 2 . . . and TL N. These transmission lines are coupled to solders pads, such as the solder pads 812*a* and 812*b*, which are coupled to the driving elements 804*a* and 804*b*, respectively, in FIG. 8. The patterns and dimensions of the driving elements and the parasitic elements of the matching component 912 can be configured to provide proper impedance matching and isolation for the multiple RF paths. The terminal 916 of the matching component 912 may be coupled to ground, kept open, or coupled to another circuit, such as the circuit block 604 in FIG. 6. The terminal 916 and the circuit may be integrated with the matching component 912, such as the configuration with the circuit block 704 in FIG. 7. When one or more impedance-varying circuit block are coupled to the matching component 912, such a configuration can be used to fine-tune the impedance matching by adjusting the designs of the matching component, the one or more circuit blocks, or a combination of both.

Figure 10:
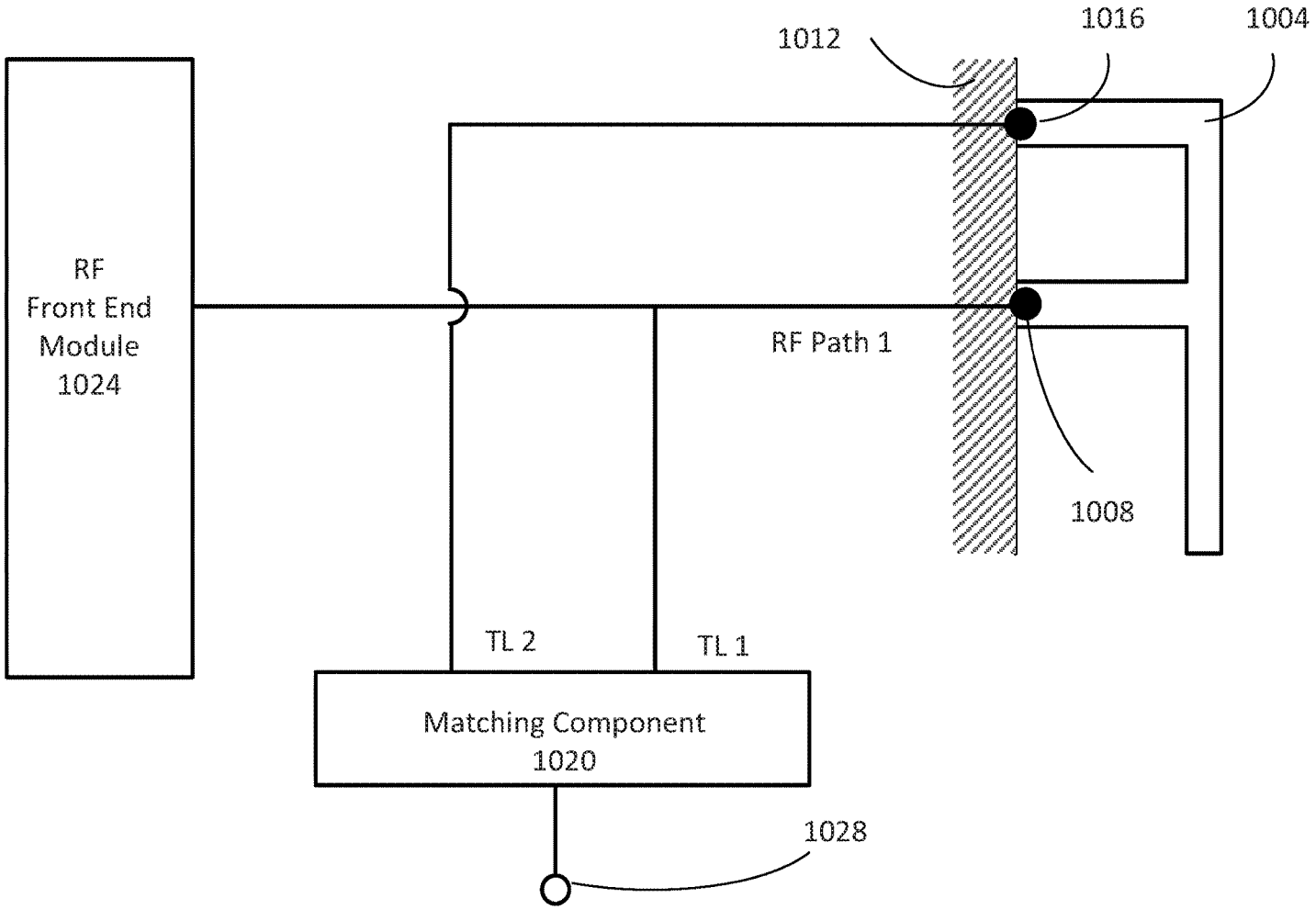
FIG. 10 illustrates an example of a communication system including an inverted F antenna (IFA) and a matching component coupled to the IFA.

The matching component can be further configured to couple to a specific location of an antenna, which is different from the feed point. FIG. 10 illustrates an example of a communication system including an inverted F antenna (IFA) and a matching component coupled to the IFA. The IFA 1004 is a variation of a bent monopole antenna, with an offset feed 1008. The antenna geometry resembles the letter F, rotated to face the ground place 1012. The upper arm portion of the IFA 1004 is shorted to the ground plane 1012, providing the shorting point 1016. It should be appreciated that designs, properties and implementations of IFAs are well known to those of ordinary skill in the art. The matching component 1020 is coupled to the IFA 1004 through a transmission line TL 1, which is coupled in shunt to the RF path 1, which is coupled to the feed point 1008 of the IFA 1004. The other end of the RF path 1 is coupled to an RF front end module 1024 to transmit/receive the RF signals. The terminal 1028 of the matching component 1020 may be coupled to ground, kept open, or coupled to another circuit, such as the circuit block 604 in FIG. 6. The terminal 1028 and the circuit may be integrated with the matching component 1020, such as the configuration with the circuit block 704 in FIG. 7. The matching component 1020 in this example is also coupled to the shorting point 1016 of the IFA 1004 through a transmission line TL 2. As illustrated in this example, by coupling the matching component to a feed point and one or more other locations of the antenna, the matching component can be configured to enhance the impedance matching with the ability and flexibility to adjust properties at the multiple locations of the antenna.

Figure 11:
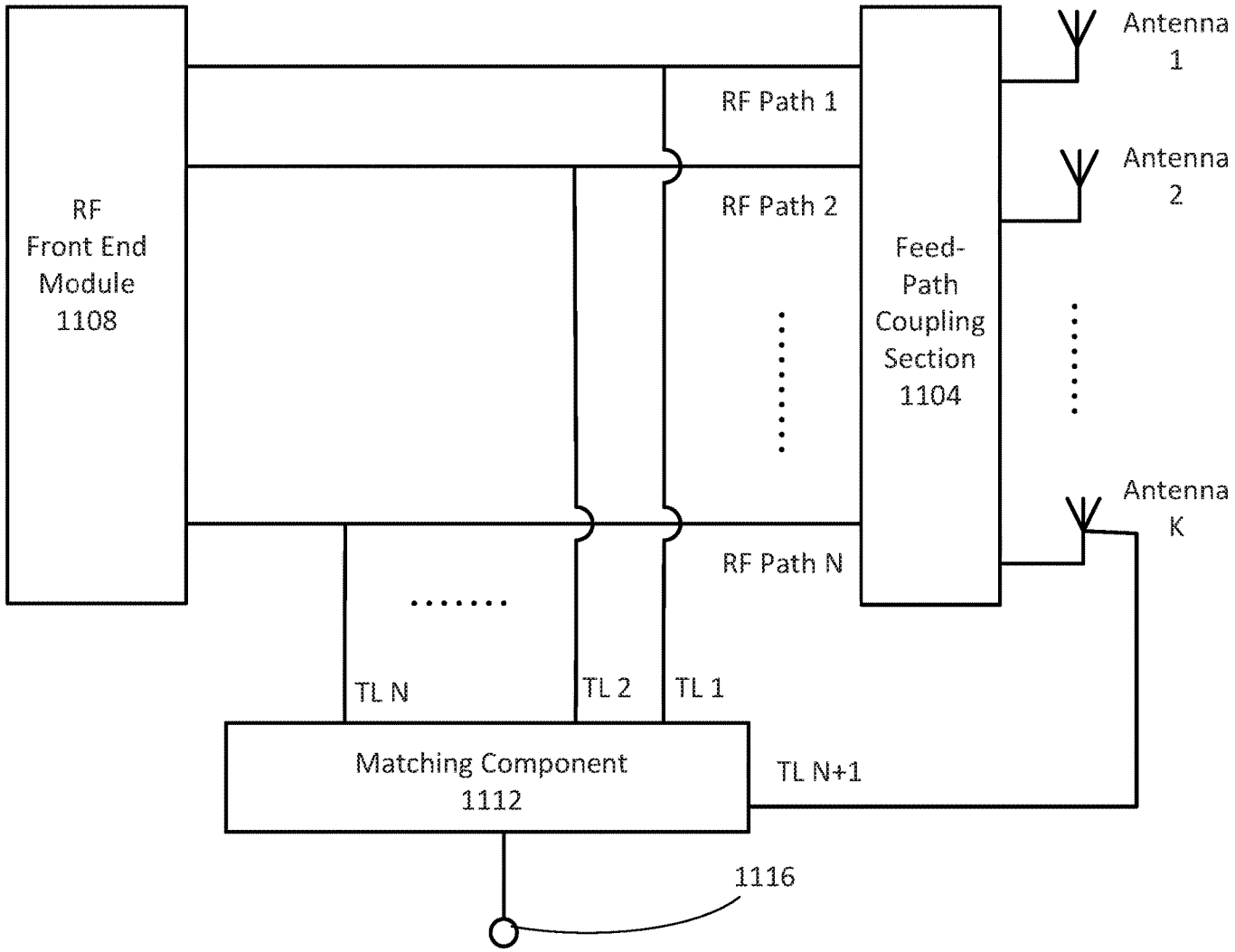
FIG. 11 illustrates an example of a communication system including one or more antennas and a matching component, wherein the configuration of the system is similar to the one illustrated in FIG. 9, except that the matching component is further coupled to a location of an antenna, which is different from the feed point.

FIG. 11 illustrates an example of a communication system including one or more antennas and a matching component. In this example, the configuration of the system is similar to the one illustrated in FIG. 9, except that the matching component 1112 is further coupled to a location of an antenna, which is different from the feed point. Specifically, the system includes K antennas, labeled Antenna 1, Antenna 2 . . . and Antenna K, where K≥1. At least one antenna may be a multi-feed antenna and the others may be single-feed antennas; all antennas may be single-feed antennas; or only one multi-feed or single-feed antenna may be used (i.e., K=1). In each of the antenna configurations, the present system is configured to provide N feeds, where N≥1. Thus, the system in this example is configured to support N different bands with N RF paths, labeled RF Path 1, RF Path 2 . . . and RF Path N, respectively. Here, the N RF paths are coupled to the N-number of feeds, respectively, via a feed-path coupling section 1104, in a capacitive way, an inductive way, a combination of both or other suitable methods. The other ends of the RF paths are coupled to an RF front end module 1108. The matching component 1112 is configured for an N-band system in this example, and coupled in shunt to each of the RF paths through transmission lines TL1, TL 2 . . . or TL N. The terminal 1116 of the matching component 1112 may be coupled to ground, kept open, or coupled to another circuit, such as the circuit block 604 in FIG. 6 or the circuit block 704 in FIG. 7. Here, the matching component 1112 is configured to couple to a location of Antenna K through a transmission line TL N+1. As in the example of FIG. 10, by coupling the matching component to the feed point and one or more other locations of the antenna, the matching component can be configured to enhance the impedance matching with the ability and flexibility to adjust properties at the multiple locations of the antenna. In a multi-antenna system, in addition to the feed points of respective antennas, the matching component can be configured to couple to one or more locations of one antenna, or to one or more locations of each of two or more antennas, wherein the coupling points are different from the feed points.

Figure 12:
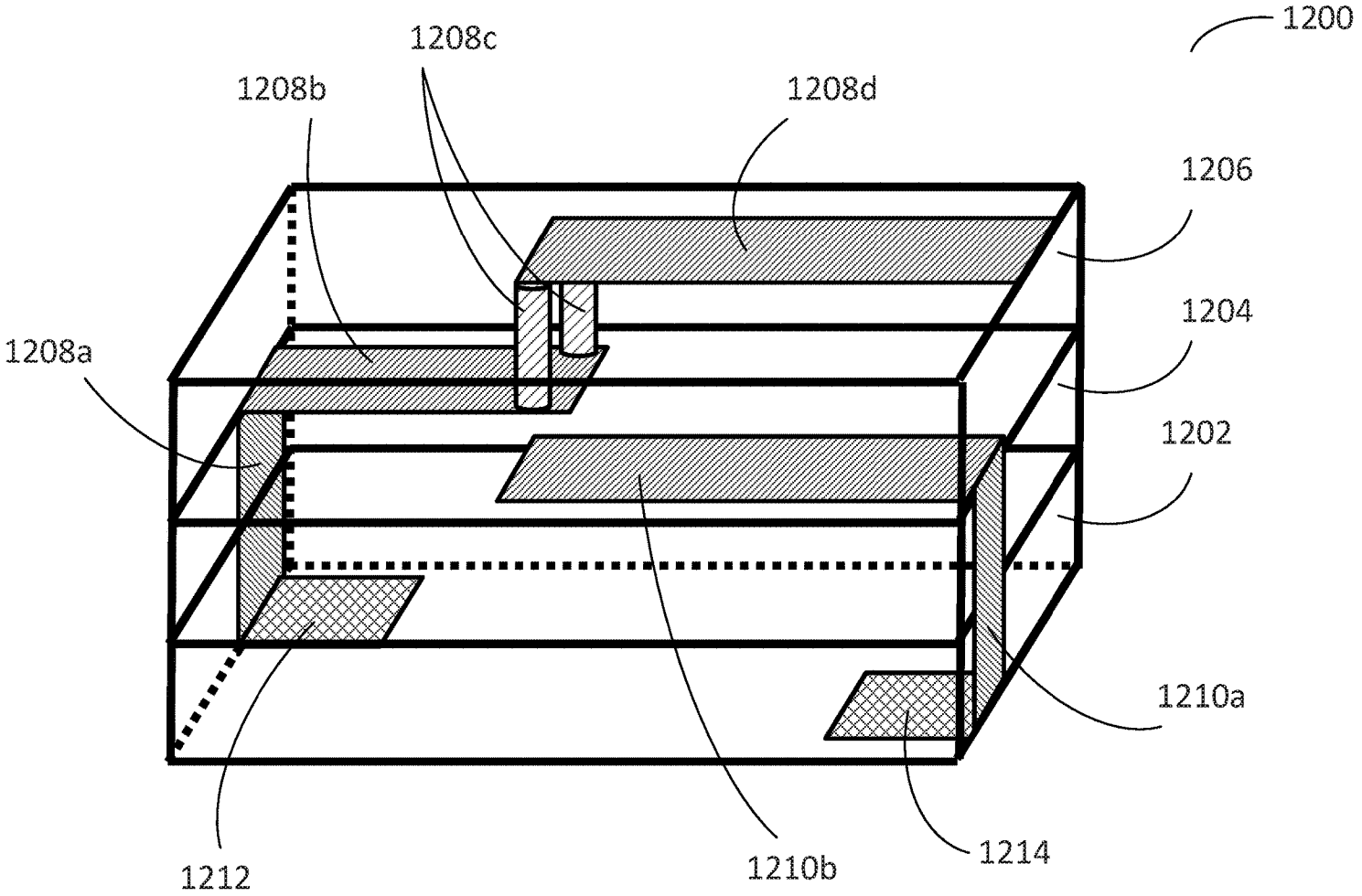
FIG. 12 illustrates an example of a matching component configured by using a three-layer substrate.

Referring back to FIGS. 1, 6, 7, 8 and 8A, these matching components are configured to include conductive portions formed on the substrate that has one layer. Capability and flexibility of matching components may be extended by using a multi-layer substrate. FIG. 12 illustrates an example of a matching component configured by using a three-layer substrate. The matching component 1200 is configured to include multiple conductive portions based on the three-layer substrate, which has a first layer 1202, a second layer 1204 and a third layer 1206. The conductive portions include a driving element comprising a first conductive patch 1208*a* formed on the side surface of the first layer 1202 and the second layer 1204, a second conductive patch 1208*b* connected to the first conductive patch 1208*a* and formed between the top surface of the second layer 1204 and the bottom surface of the third layer 1206, one or more vias 1208*c* connected to the second conductive patch 1208*b* and formed in the third layer 1206 to penetrate therethrough, and a third conductive patch 1208*d* connected to the one or more vias 1208*c* and formed on the top surface of the third layer 1206. The conductive portions further include a parasitic element comprising a fourth conductive patch 1210*a* formed on the side surface of the first layer 1202 and the second layer 1204, and a fifth conductive patch 1210*b* connected to the fourth conductive patch 1210*a* and formed between the top surface of the second layer 1204 and the bottom surface of the third layer 1206. The conductive portions further include a solder pad 1212 connected to the first conductive patch 1208*a* and formed on the bottom surface of the first layer 1202. The conductive portions further include another solder pad 1214 connected to the fourth conductive patch 1210*a* and formed on the bottom surface of the first layer 1202.

Figure 13:
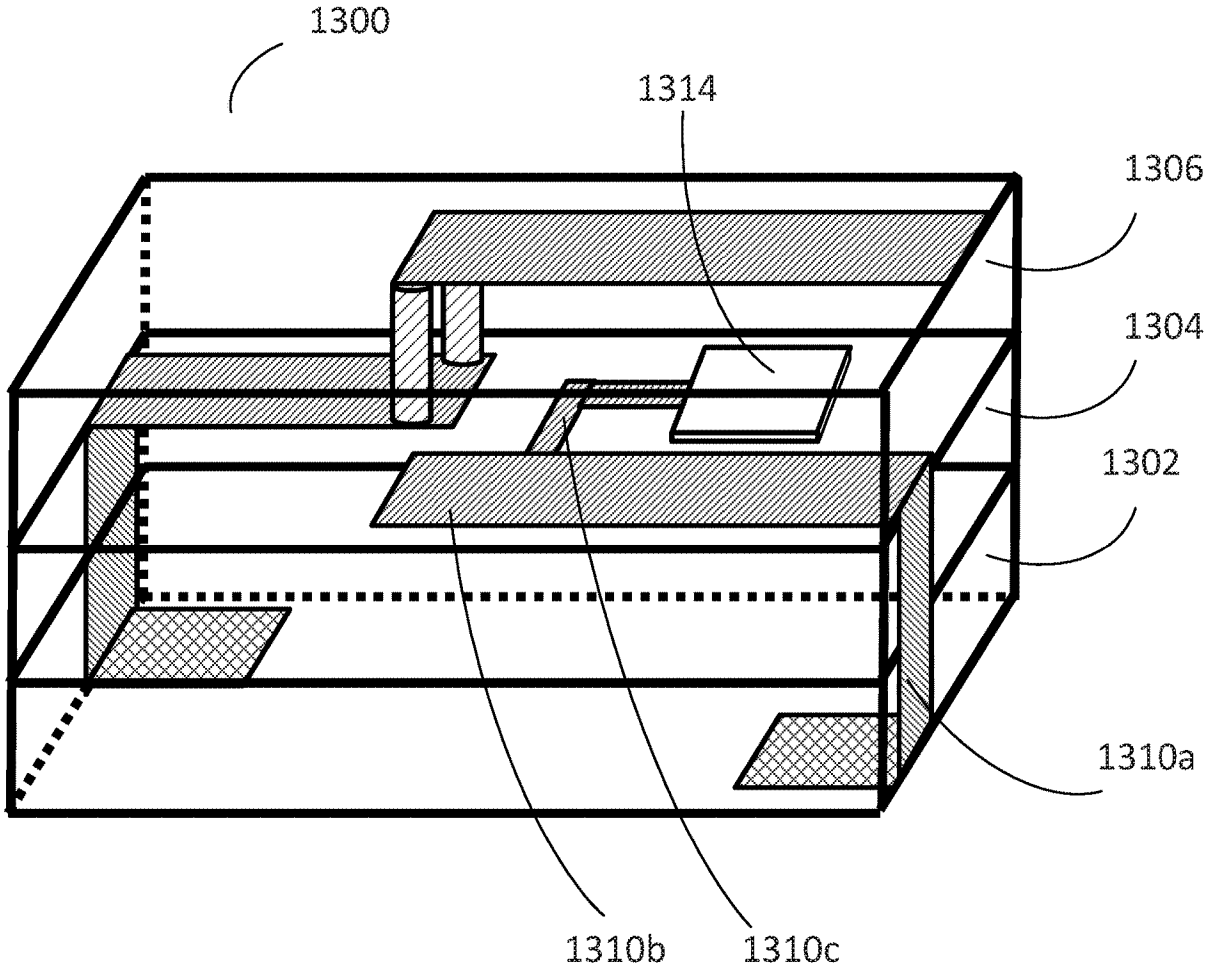
FIG. 13 illustrates an example of a matching component with a circuit block configured by using a three-layer substrate.

FIG. 13 illustrates an example of a matching component with a circuit block configured by using a three-layer substrate. The matching component 1300 is configured to include multiple conductive portions based on the three-layer substrate, which has a first layer 1302, a second layer 1304 and a third layer 1306. In this example, the conductive portions are formed similar to those of the matching component 1200 of FIG. 12, except that the parasitic element includes an L-shaped conductive patch 1310*c* in addition to a conductive patch 1310*a* formed on the side surface of the first layer 1302 and the second layer 1304 and another conductive patch 1310*b* formed between the top surface of the second layer 1304 and the bottom surface of the third layer 1306. The L-shaped conductive patch 1310*c* is formed between the top surface of the second layer 1304 and the bottom surface of the third layer 1306 and connected to the conductive patch 1310*b*. This configuration further includes a circuit block 1314 placed between the top surface of the second layer 1304 and the bottom surface of the third layer 1306, and coupled to the L-shaped patch 1310*c*. This example illustrates an integrated configuration of the circuit block 1314 and the matching component 1300; however, the circuit block may be physically separated from and electrically coupled to the matching component 1300, as in the example of FIG. 6. The configuration having both a matching component and an impedance-varying circuit block, such as 1314, can be used to fine-tune the impedance matching by adjusting the designs of the matching component, the circuit block, or a combination of both.

The three-layer substrate is used to configure the matching components in FIGS. 12 and 13. As is obvious to those skilled in the art, the number of layers can be varied depending on the design, with variations including a combination of horizontal and vertical layers, a combination of layers with different dimensions, and so on. Designs and implementations of the matching component based on a multi-layer substrate for a single-band system, such as those illustrated in FIGS. 12 and 13, can be extended for a system for two or more bands by increasing the number of and varying the dimensions and shapes of individual conductive portions on the multi-layer substrate. The number of driving elements and the number of parasitic elements may be the same or different, wherein the driving elements are configured to couple to the multiple antennas, as in FIG. 9 or 11. Furthermore, meander lines, extended or bent arms and/or other conductive elements may be added to have a wide variety of impedance forms over a wide frequency range. Furthermore, one or more inductive elements may be included, each connecting a pair of driving elements coupled to two different antennas, respectively, in order to increase isolation between the antennas. Furthermore, one or more parasitic elements may be coupled to one or more circuit blocks, respectively, to fine-tune the impedance matching.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A matching component comprising:

a substrate; and conductive patches formed on the substrate, the conductive patches comprising driving elements and parasitic elements;

wherein the conductive patches of the matching component provide impedance matching for two different antennas that are separate from the conductive patches of the matching component and coupled to the matching component;

wherein the conductive patches further include one or more inductive elements, each of which is connected to a pair of driving elements coupled to the two different antennas, respectively, to increase isolation between the two different antennas.

2. The matching component of claim 1, wherein at least one of the parasitic elements is coupled to a circuit block to facilitate impedance matching.

3. The matching component of claim 1, wherein the substrate is a single-layer substrate.

4. The matching component of claim 1, wherein the substrate is a multi-layer substrate.

5. The matching component of claim 1, wherein at least one of the conductive patches comprises an L-shaped arm.

6. The matching component of claim 5, wherein the L-shaped arm is coupled to a circuit block to facilitate impedance matching.

7. An antenna system comprising:

a front end module;

at least one RF path coupling the front end module with two different antennas;

a matching component coupled with the at least one RF path and configured to provide impedance matching for the two different antennas, the matching component comprising:

a substrate; and conductive patches formed on the substrate, the conductive patches comprising driving elements and parasitic elements;

wherein the conductive patches further include one or more inductive elements, each of which is connected to a pair of driving elements coupled to the two different antennas, respectively, to increase isolation between the two different antennas.

8. A matching component comprising:

a substrate having a top surface, a side surface, and a bottom surface opposite the top surface;

conductive patches formed on the substrate, the conductive patches at least partially formed on the top surface of the substrate; and at least one solder pad disposed on the bottom surface of the substrate; wherein the conductive patches comprise driving elements and parasitic elements;

wherein the conductive patches provide impedance matching for two different antennas coupled to the matching component; and wherein at least one of the conductive patches is formed at least partially on the side surface of the substrate and extends from the top surface to the bottom surface to electrically connect the at least one of the conductive patches that is formed on the top surface with the at least one solder pad disposed on the bottom surface of the substrate.

9. The matching component of claim 8, wherein at least one of the parasitic elements is coupled to a circuit block to facilitate impedance matching.

10. The matching component of claim 8, wherein at least one of the conductive patches comprises an L-shaped arm.

11. The matching component of claim 10, wherein the L-shaped arm is coupled to a circuit block to facilitate impedance matching.

* * * * *